US006696119B2

(12) United States Patent
Obara et al.

(10) Patent No.: US 6,696,119 B2
(45) Date of Patent: Feb. 24, 2004

(54) THERMAL INK-TRANSFER RECORDING MATERIAL

(75) Inventors: Yuji Obara, Tochigi (JP); Yoichi Shutara, Tochigi (JP); Tetsuya Abe, Tochigi (JP)

(73) Assignee: Sony Chemicals Corporation, Tokyo (JP)

( * ) Notice: Subject to any disclaimer, the term of this patent is extended or adjusted under 35 U.S.C. 154(b) by 0 days.

(21) Appl. No.: 09/100,408

(22) Filed: Jun. 19, 1998

(65) Prior Publication Data

US 2002/0018878 A1 Feb. 14, 2002

(30) Foreign Application Priority Data

Jun. 19, 1997 (JP) ..... 9-163151

(51) Int. Cl.[7] ..... B41M 5/26
(52) U.S. Cl. ..... 428/32.8; 428/32.6; 428/32.81
(58) Field of Search ..... 428/195, 484, 428/488.1, 423.1, 32.8, 32.81, 32.6

(56) References Cited

U.S. PATENT DOCUMENTS

| | | | | |
|---|---|---|---|---|
| 3,663,278 A | * | 5/1972 | Blose et al. | |
| 4,783,360 A | * | 11/1988 | Katayama et al. | 428/488.1 |
| 4,970,119 A | | 11/1990 | Koshizuka et al. | |
| 5,045,383 A | | 9/1991 | Maeda et al. | |
| 5,538,831 A | | 7/1996 | Oshima et al. | |
| 5,827,617 A | | 10/1998 | Krauter | |

FOREIGN PATENT DOCUMENTS

| | | | | |
|---|---|---|---|---|
| EP | 0 381 297 A1 | | 8/1990 | |
| JP | 03224795 A | * | 10/1991 | B41M/5/40 |

* cited by examiner

*Primary Examiner*—Pamela R. Schwartz
(74) *Attorney, Agent, or Firm*—Rosenthal & Osha L.L.P.

(57) ABSTRACT

In a thermal ink-transfer recording material comprising a support, and a primer layer and a thermal transferring ink layer which are superposed on the support in this order, the thermal transferring ink layer comprising a binder and a colorant dispersed in the binder, the primer layer is constituted of at least two types of resins that are not compatible with each other so that the recording material is separable at the interface between the support and the primer layer.

1 Claim, 1 Drawing Sheet

THERMAL INK-TRANSFER RECORDING MATERIAL

BACKGROUND OF THE INVENTION

1. Field of the Invention

This invention relates to a thermal ink-transfer recording material of a thermal melt transfer type.

2. Description of the Related Art

Thermal ink-transfer recording materials having a double-layer structure comprising a support made of polyester or the like and provided thereon a thermal transferring ink layer formed of a binder with a colorant dispersed therein are conventionally put into wide use.

Such thermal ink-transfer recording materials having a double-layer structure, however, have a problem that, when a low-melting wax is used as a binder in order to improve thermal transfer performance, transferred images formed may have a greatly low rub resistance. In order to improve the rub resistance, it has been attempted to use an elastomer resin as the binder. In such an instance, however, there has been a problem that the thermal transferring ink layer adheres to the support in so high a strength that the thermal transferring ink layer may have a low transfer performance and also may make images have a low quality.

Under such circumstances, in order to make the thermal transferring ink layer better releasable from the support and yet make the resultant transferred images have an improved rub resistance, a thermal ink-transfer material is proposed in which a hot-melt layer comprised chiefly of a wax having a penetration of 5 or less is formed between the support and the thermal transferring ink layer (Japanese Patent Publication No. 4-73390). In the thermal transfer recording carried out using this thermal ink-transfer material, the thermal transferring layer is separated from the support, and hence the surface of a transferred image consequently obtained is covered with the hot-melt layer. Thus, the rub resistance of transferred images can be improved.

A thermal printing material is also proposed in which a transparent protective layer comprised of a styrene-methacrylate copolymer and a vinyl chloride resin is formed between the support and the thermal transferring ink layer (Japanese Patent Publication No. 3-18837). In the thermal transfer recording carried out using this thermal printing material, the transparent protective layer comprised chiefly of the resin is separated from the support, and hence the surface of a transferred image consequently obtained is covered with the transparent protective layer. Thus, the rub resistance of transferred images can be greatly improved.

However, in the case when the layer that covers the surface of a transferred image to ensure its rub resistance is a layer comprised chiefly of wax as disclosed in Japanese Patent Publication No. 4-73390, the rub resistance is insufficient for practical use, and it has been sought to more improve the rub resistance.

As for the case when the layer that covers the surface of a transferred image to ensure its rub resistance is a transparent protective layer comprised chiefly of resin as disclosed in Japanese Patent Publication No. 3-18837, the rub resistance can be more improved than the case when the wax is used. In order to realize a good thermal transfer performance, however, the adhesion between the support and the transparent protective layer must be made stronger than the adhesion between the transparent protective layer and the thermal transferring ink layer. For this reason, in the thermal transferring ink layer, it can not avoid using as the binder a resin (a styrene-methacrylate copolymer, a vinyl chloride resin or polymethyl methacrylate) having a high affinity for the resin used in the transparent protective layer. This has brought about a problem that any wax type binders can not be used which are more advantageous than resin type binders in view of materials cost and thermal transfer performance.

As another problem, such a transparent protective layer formed chiefly of resin can not always be separated at the interface between that layer and the support, and is apt to cause cohesive failure in the thermally transferring transparent protective layer or thermal transferring ink layer. In such an instance, the transferred image surface may have a low gloss, resulting in a low image quality. As a still another problem, there are limitations on the material and surface properties of the image-receiving transfer medium side, lacking in general-purpose properties.

SUMMARY OF THE INVENTION

The present invention solves the above problems the prior art has had. Accordingly, an object of the present invention is to provide, in an instance where a primer layer capable of covering the surface of a transferred image upon operation of thermal transfer is formed between the support and the thermal transferring ink layer, a thermal ink-transfer recording material that can impart a good rub resistance and a superior surface gloss to transferred images and also can have a good thermal transfer performance even when a wax type binder is used as the binder of the thermal transferring ink layer.

The present inventors have discovered that the above object can be achieved by forming a primer layer constituted chiefly of a resin component and using as the resin component at least two types of resins that are not compatible with each other, thus they have accomplished the present invention.

More specifically, the present invention provides a thermal ink-transfer recording material comprising a support, and a primer layer and a thermal transferring ink layer which are superposed on the support in this order; the thermal transferring ink layer comprising a binder and a colorant dispersed in the binder; wherein;

the primer layer contains at least two types of resins that are not compatible with each other so that the recording material is separable at the interface between the support and the primer layer.

DETAILED DESCRIPTION OF THE INVENTION

Figure 1:
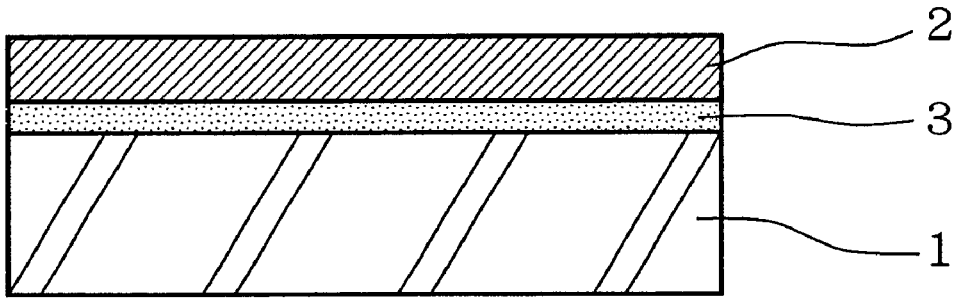
FIG. 1 is a cross-sectional view of the thermal ink-transfer recording material of the present invention.

The present invention will be described below in greater detail.

FIG. 1 cross-sectionally illustrates an example of the thermal ink-transfer recording material of the present invention. This thermal ink-transfer recording material has a structure wherein a primer layer 3 is formed between a support 1 and a thermal transferring ink layer 2 comprising a binder and a colorant dispersed in the binder.

In the thermal ink-transfer recording material of the present invention, the primer layer 3 is constituted chiefly of a resin component. Hence, compared with the instance where a wax is used, a good rub resistance can be imparted to transferred images. Also, at least two types of resins that are incompatible with each other are used as the resin component constituting the primer layer 3. This enables the recording material to be separable at the interface between the support 1 and the primer layer 3, so that a high glossiness can be imparted to the transferred images. Moreover, the recording material can be separated without trailing the non-heated areas present around the heated areas of the thermal transferring ink layer 2, and hence a sharp transferred image can be formed.

Herein, the extent of "incompatible" means that regions where the two types of resins stand not compatible with each other are formed in the primer layer 3. Accordingly, a part of one resin may be dissolved into the other resin so long as the regions where the two types of resins stand not compatible with each other are formed in the primer layer 3.

In the present invention, three or more types of resins may be used as the resin component of the primer layer 3. In the case when three types of resins are used, all the three types of resins may be incompatible with one another, or one resin may be incompatible with the other two types of resins which are compatible with each other.

In the present invention, as one of the two types of resins incompatible with each other which constitute the primer layer 3, a resin of a urethane type including polyether urethanes and polyester urethanes may preferably be used in view of the adhesion to the support 1 and thermal transferring ink layer 2.

In the case when the urethane resin is used as one of the two types of resins incompatible with each other, the other resin incompatible with it may preferably be at least one resin selected from the group consisting of vinyl resins, styrene resins, ethyl cellulose resins, polyester resins and butyral resins.

As to the proportion of such a urethane resin to the resin component of the primer layer 3, its use in a too small proportion may cause coming-off of the thermal transferring ink layer 2. Its use in a too large proportion may make the adhesion so strong at the time of thermal transfer as to cause cohesive failure of the thermal transferring ink layer 2, resulting in no sharp printing and also a low image density. Accordingly, the urethane resin may preferably be used in an amount of from 5 to 50% by weight, and more preferably from 10 to 30% by weight, of the resin component.

In the present invention, the primer layer 3 may preferably be incorporated with carbon (in particular, conductive carbon) in order to prevent the thermal ink-transfer recording material from being statically charged at the time of transfer. Usually, the carbon may preferably be in a content of from 5 to 70% by weight of the solid content of the primer layer 3.

The incorporation of the carbon also enables the primer layer 3 to function as the thermal transferring ink layer, and can improve the transfer density of transferred images.

There are no particular limitations on the thickness of the primer layer 3 described above. However, a too thick primer layer may cause a low heat-sensitivity and a too thin primer layer can not well improve printing density and conductivity. Accordingly, it may preferably be in a thickness of from 0.3 to 0.4 $\mu$m.

In the present invention, the thermal transferring ink layer 2 is a layer comprising a binder and a colorant dispersed in the binder. Such a colorant may be used under appropriate selection from among colorants (e.g., carbon black, titanium white and various dyes) used in conventional thermal transferring ink layers. As the binder, any binders (wax type binders and resin type binders) conventionally used in thermal transferring ink layers may be used. The wax type binders may preferably be used, which are superior in low-cost availability and thermal transfer performance. When in this way the primer layer is constituted chiefly of resin, even with use of a wax type binder as the binder of the thermal transferring ink layer 2, the separation at the interface between the support 1 and the primer layer 3 can be achieved without causing any separation at the interface between the thermal transferring ink layer 2 and the primer layer 3, so that a sharp and highly glossy transferred image can be formed.

There are no particular limitations on the thickness of the thermal transferring ink layer 2, which may usually be in a thickness of from 2.5 to 3 $\mu$m. On the thermal transferring ink layer 2, an adhesion-providing layer may optionally be further provided.

In the present invention, as the support 1, any supports may be used which are conventionally used in thermal ink-transfer recording materials. For example, polyethylene terephthalate film may preferably be used.

In the thermal ink-transfer recording material of the present invention, in order to prevent sticking to the thermal head and also to ensure traveling performance of the thermal ink-transfer recording material, a known heat-resistant lubricating layer may be optionally formed on the surface of the support 1 on its side opposite to the primer layer 3.

The thermal ink-transfer recording material of the present invention can be produced by a conventional process. For example, it can be produced by coating a primer layer coating composition on the support 1 by means of a gravure coater or the like, followed by drying to form the primer layer 3, and coating thereon a thermal transferring ink layer coating composition, followed by drying to form the thermal transferring ink layer 2.

The thermal ink-transfer recording material of the present invention can form a transferred image on a transfer medium such as paper or a resin sheet (e.g., a vinyl chloride sheet) by the use of a usual thermal transfer printer having a thermal head as a heating means.

EXAMPLES

The present invention will be described below in greater detail by giving Examples.

Example 1

On one side of a polyester film (thickness: 4.9 $\mu$m; available from Teijin Limited) having been subjected to heat-resistant lubricating treatment on the back, a primer layer coating composition shown in Table 1, containing a urethane resin and a polyester which are not compatible with each other, was coated by means of a bar coater, followed by drying at 110° C. to form a primer layer of 0.4 $\mu$m thick.

TABLE 1

| Components | Amount (wt. %) |
|---|---|
| Urethane resin (55% solid content)*1 | 3.96 |
| Polyester*2 | 2.18 |
| carbon dispersion(18.5% solid content)*3 | 45.36 |
| Toluene | 48.36 |

Notes of Table 1
*1: EA1443(trade name), available from Daicel Chemical Industries, Ltd.
*2: VYRON 200(trade name), available from Toyobo Co., Ltd.
*3: MHI-273(trade name), available from Mikuni Color Works Ltd.

Next, on the primer layer, a thermal transferring ink layer coating composition shown in Table 2 was coated by means of a bar coater, followed by drying at 100° C. to form a thermal transferring ink layer of 3.0 $\mu$m thick. Thus, a thermal ink-transfer recording material was obtained.

TABLE 2

| Components | Amount (wt. %) |
|---|---|
| Carbon black*4 | 9.21 |
| Carnauba wax*5 | 17.86 |
| Paraffin wax*6 | 17.75 |
| Ethylene/vinyl acetate copolymer*7 | 3.42 |
| Softener | 0.83 |
| Dispersant | 0.93 |
| Toluene | 50.00 |

Notes of Table 2
*4: PEARLS 130(trade name), available from Cabot Corp.
*5: available from Katoh & Co., Ltd.
*6: HNP-10(trade name), available from Nippon Seiro Co., Ltd.
*7: MB-11(trade name), available from Sumitomo Chemical Co., Ltd.

Example 2

A thermal ink-transfer recording material was produced in the same manner as in Example 1 except that VYLON 200 in the primer layer coating composition was replaced with a polyester resin (ES-110, trade name; available from Sunkyong Co.), not compatible with the urethane resin.

Example 3

A thermal ink-transfer recording material was produced in the same manner as in Example 1 except that VYLON 200 in the primer layer coating composition was replaced with an acrylstyrene resin (P-595, trade name; available from Sekisui Chemical Co., Ltd.), not compatible with the urethane resin.

Example 4

A thermal ink-transfer recording material was produced in the same manner as in Example 1 except that VYLON 200 in the primer layer coating composition was replaced with a polystyrene resin (ENDEX 155, trade name; available from Hercules Inc.), not compatible with the urethane resin.

Example 5

A thermal ink-transfer recording material was produced in the same manner as in Example 1 except that VYLON 200 in the primer layer coating composition was replaced with an ethyl cellulose resin (N-4, trade name; available from Hercules Inc.), not compatible with the urethane resin.

Example 6

A thermal ink-transfer recording material was produced in the same manner as in Example 1 except that VYLON 200 in the primer layer coating composition was replaced with a butyral resin (BL-3, trade name; available from Sekisui Chemical Co., Ltd.), not compatible with the urethane resin.

Comparative Example 1

A thermal ink-transfer recording material was produced in the same manner as in Example 1 except that VYLON 200 in the primer layer coating composition was replaced with nitrocellulose (HIG1/2, trade name; available from Asahi Chemical Industry Co., Ltd.), compatible with the urethane resin.

Comparative Example 2

A thermal ink-transfer recording material was produced in the same manner as in Example 1 except that VYLON 200 in the primer layer coating composition was replaced with cellulose acetate butyral (CAB551, trade name; available from Eastman Kodak Co.), compatible with the urethane resin.

Comparative Example 3

A thermal ink-transfer recording material was produced in the same manner as in Example 1 except that VYLON 200 in the primer layer coating composition was replaced with a vinyl chloride-vinyl acetate copolymer resin (VA-GH, trade name; available from Union Carbide), compatible with the urethane resin.

Comparative Example 4

A thermal ink-transfer recording material was produced in the same manner as in Example 1 except that VYLON 200 in the primer layer coating composition was replaced with a vinyl chloride resin (MR-110, trade name; available from Nippon Zeon Co., Ltd.), compatible with the urethane resin.

Evaluation

With regard to the thermal ink-transfer recording materials obtained in Examples 1 to 6 and Comparative Examples 1 to 4, print quality, print density, separation boundary, glossiness and rub resistance were tested and evaluated in the manner as described below.

Results obtained are shown in Table 3.

Print quality

The thermal ink-transfer recording material was attached to a commercially available thermal transfer printer (Z-140, trade name; manufactured by Zebra Co.), and a bar code pattern image was thermal-transferred (printing energy: 14 $mJ/mm^2$; printing speed: 6 inches/second) to a coated label paper (FASSON 1C, trade name; available from Fasson Co.). Transferred images obtained were visually observed to make evaluation according to the following evaluation criteria.

Evaluation criteria

Rank

A: Neither jerking nor sticking occurs, and the pattern is transferred with good bar code pattern edges.

B: Faulty transfer is a little seen at bar code pattern edges.

C: Faulty transfer is clearly seen.

Print density

Thermal-transferred images were formed in the same manner as the evaluation of print quality except that the bar code printing was replaced with solid printing. Optical density of the images formed was measured with a Macbeth densitometer (TR-926). The greater the numerical value obtained is, the higher the print density is.

Separation boundary

The surface of the thermal transferring ink layer of the thermal ink-transfer recording material having been used to form images when the print density was evaluated was observed to specify the boundary at which the recording material was separated.

Recording Material was Separated

A: At the interface between the support and the primer layer.

B: With cohesive failure of the primer layer.

C: At the interface between the primer layer and the thermal transferring ink layer.

Glossiness

When the print density was evaluated, the surface glossiness of images formed was measured with a glossiness measuring device (GLOSS CHECKER IG310, trade name; manufactured by Horiba Seisakusho). The greater the numerical value obtained is, the higher the glossiness is.

Rub resistance

Bar code patterns were thermal-transferred in the same manner as in the evaluation of print quality except that the coated paper (FASSON 1C, trade name; available from Fasson Co.) was replaced with gloss-coated paper (K8TB, trade name; available from Tec Co.). The transferred images thus formed were put to a cotton cloth rubbing test of 20-time rubbing with cotton cloth under a load of 800 g, using a rubbing test machine (Rubbing Tester AB-301, trade name, manufactured by Tester Co.). Bar codes having been put to the rubbing test were visually observed to make evaluation according to the following evaluation criteria.

Rub resistance evaluation criteria:

Rank

AA: An instance where no damage is seen at all on the images.

A: An instance where almost no damage is seen.

B: An instance where damage is seen at few areas.

C: An instance where damage occurs in a fairly large number.

TABLE 3

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Evaluation items | | | | | | | | | | |
| Print quality: | A | A | A | A | B | A | C | B | C | C |
| Print density: | 2.15 | 2.12 | 2.02 | 2.20 | 1.95 | 2.00 | 1.56 | 1.58 | 1.81 | 1.91 |
| Separation boundary: | A | A | A | A | A | A | B | C | C | C |
| Glossiness: | 77 | 74 | 79 | 77 | 73 | 74 | 49 | 68 | 53 | 63 |
| Rub resistance: | A | A | AA | A | A | A | C | B | B | B |

As can be seen from Table 3, since the thermal ink-transfer recording materials of Examples 1 to 6 comprise the primer layer formed of at least two types of resins not compatible with each other, all of them are separated at the interface between the support and the primer layer and show good results on all the evaluation items.

On the other hand, the thermal ink-transfer recording materials of Comparative Examples 1 to 4, which comprise the primer layer formed of at least two types of resins compatible with each other, are all not separated at the interface between the support and the primer layer and show unsatisfactory results on all the evaluation items.

As described above, the thermal ink-transfer recording material of the present invention can impart a good rub resistance and a superior surface gloss to transferred images and also can have a good thermal transfer performance even when a wax type binder is used as the binder of the thermal transferring ink layer.

The entire disclosure of the specification, claims, summary and drawing of Japanese Patent Application No. 09-163151 is herein incorporated by reference in its entirety.

What is claimed is:

1. A thermal ink-transfer recording material comprising a support, a primer layer, and a thermal transferring ink layer, the primer layer being disposed on the support, and the thermal transferring ink layer being disposed above the primer layer, wherein the primer layer comprises:

a resin component formed from at least two types of resins that are incompatible with each other, wherein one of the at least two types of resins comprises 5% to 30% by weight polyurethane, and another of the at least two types of resins comprises an acrylstyrene resin; and conductive carbon in an amount of from 5% to 70% by weight of a solid content of the primer layer; and the thermal transferring ink layer comprising a binder and a colorant dispersed in the binder.

* * * * *